US005249771A

United States Patent [19]

Wear

[11] Patent Number: 5,249,771

[45] Date of Patent: Oct. 5, 1993

[54] FOLDABLE SUSPENDED SIGN HANGER

[76] Inventor: Stuart C. W. Wear, 5636 Rebecca Ln., Minnetonka, Minn. 55343

[21] Appl. No.: 894,284

[22] Filed: Jun. 4, 1992

[51] Int. Cl.[5] ..... G09F 7/22

[52] U.S. Cl. ..... 248/317; 248/300; 40/539; 40/617

[58] Field of Search ..... 248/317, 300, 319.1, 248/174; 40/617, 539; 211/113

[56] References Cited

U.S. PATENT DOCUMENTS 288,853 11/1883 Poage ..... 248/317
1,400,190 12/1921 Tucker ..... 40/539
2,091,951 9/1937 Anthony ..... 248/174
4,991,335 2/1991 Krantsack ..... 40/617
5,096,073 3/1992 O'Brien ..... 40/539

*Primary Examiner*—Scott Smith
*Attorney, Agent, or Firm*—Leo Gregory

[57] ABSTRACT

A suspended sign hanger die cut from a blank with appropriate creased lines to be folded into a device having walls of narrow width and a pair of spaced pegs projecting outwardly of each wall onto which are mounted poster type signs extending beyond the length of each side of said device with a mutual yielding of their interengaging extended portions to respectively define substantially concave outward surfaces.

2 Claims, 2 Drawing Sheets

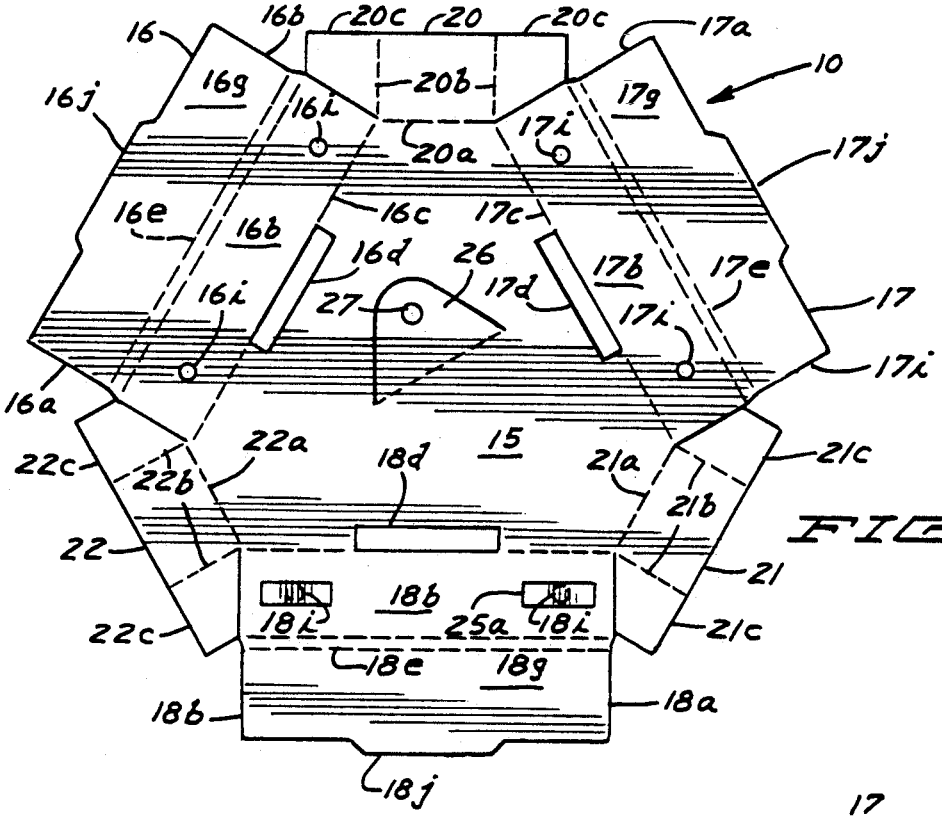
FIG. 3
FIG. 4
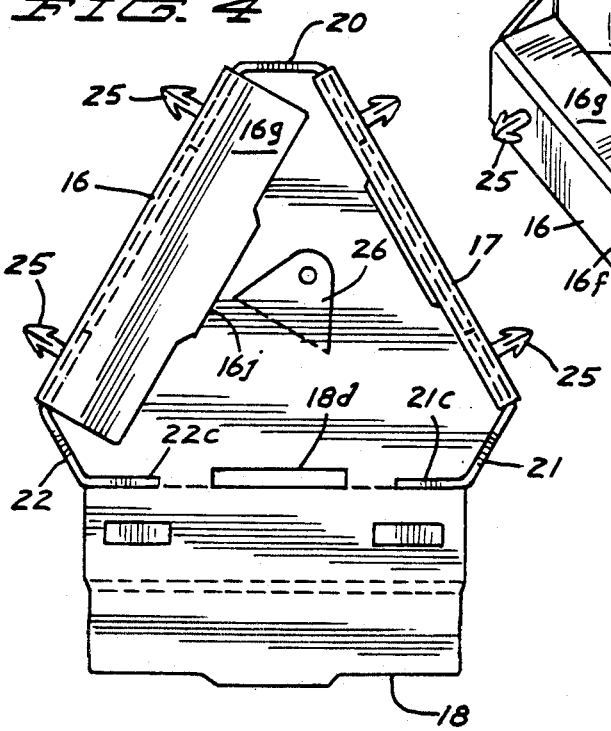
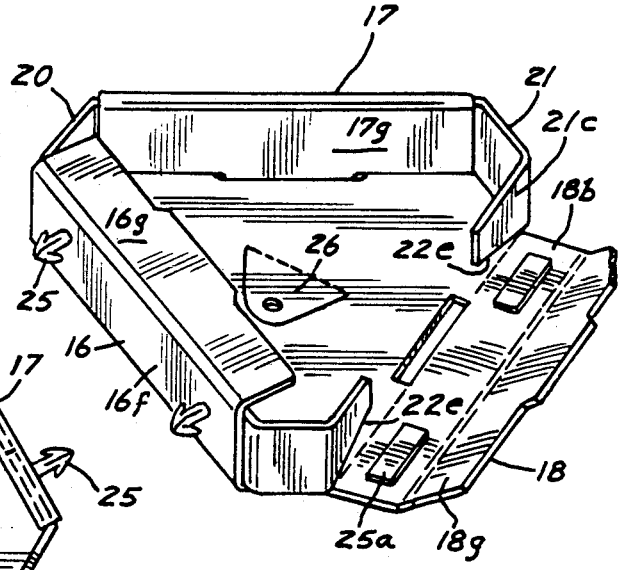
FIG. 5

FOLDABLE SUSPENDED SIGN HANGER

BACKGROUND OF THE INVENTION

1. Field of Invention

This invention relates to a suspended or mobile poster type sign hanger.

2. Brief Description of the Previous Art

A known to be presently used suspended sign hanger is a triangular substantially planar device having a central hub portion with radii extending to the sides thereof, the same being suspended in vertically spaced pairs having projecting knobs onto which hung posters are secured. This is a relatively expensive hanger being the product of an injection molding process which requires a cavity mold and such molds are very expensive items.

It is desired to provide a suspended sign hanger which is die cut and the cost of a die for cutting the hanger out of a blank will be on the order of one percent of the mold cost.

SUMMARY OF THE INVENTION

It is an object herein to provide a low cost suspended poster hanger and method for producing the same by drastically reducing its cost of production.

Hence, it is an object herein to provide a die cut instead of an extruded hanging device whereby the use of a die drastically reduces, the cost of production. Here the device is die cut out of a blank of suitable material having crease lines to simply and easily fold the blank into a formed sign or poster holder having relatively narrow side walls through which tabs are projected and onto which signs or posters are secured and hung.

Various types of inexpensive sheet material which is recyclable may be used such as cardboard stock and flexible These and other objects and advantages of the invention will be set forth in the following description made in connection with the accompanying drawings in which like reference characters refer to similar parts throughout the several views.

BRIEF DESCRIPTION OF THE DRAWINGS

FIG. 3 is a top plan view of the hanger of the invention herein in blank form;

FIG. 4 is a top plan view showing the hanger of the invention herein in a partially folded condition; and FIG. 5 is a view similar to that of FIG. 4 showing the hanger herein in a further folded condition.

DESCRIPTION OF A PREFERRED EMBODIMENT

Figure 1:
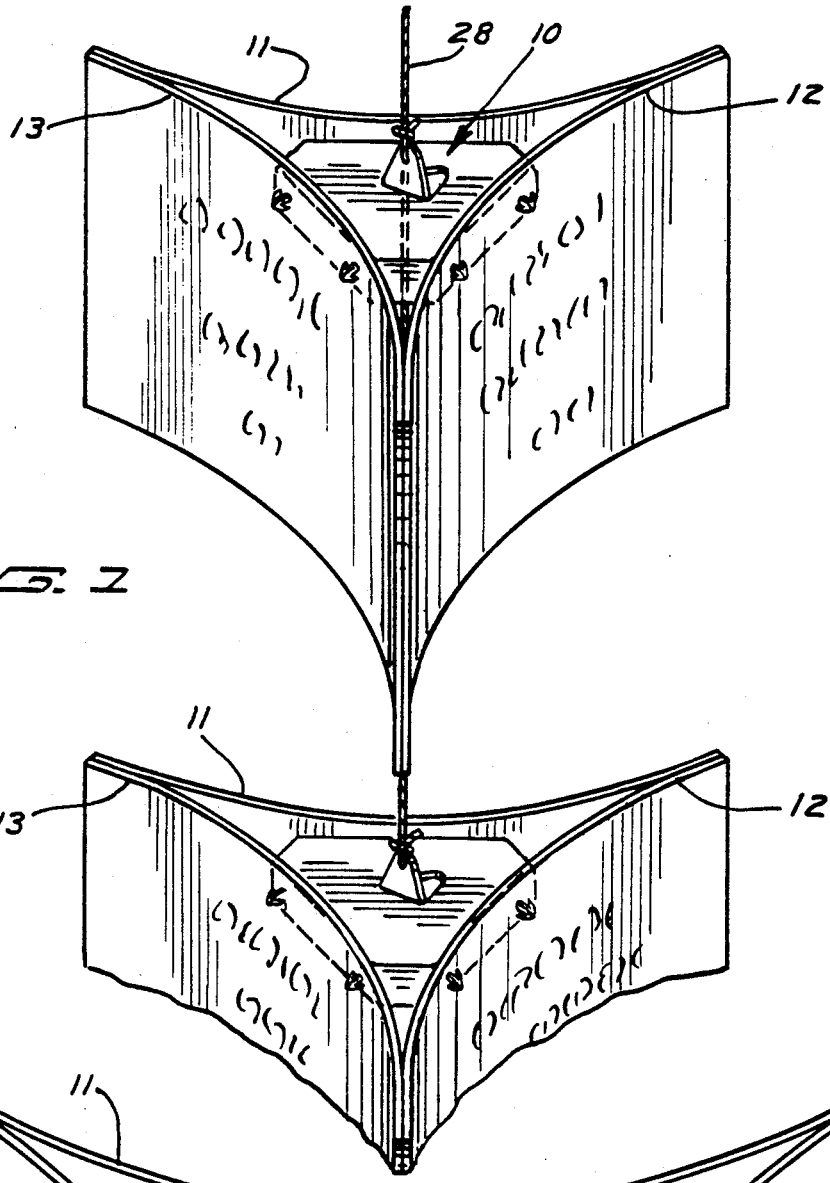
FIG. 1 is a view in perspective showing the hanger comprising the invention herein in operating position.
Figure 2:
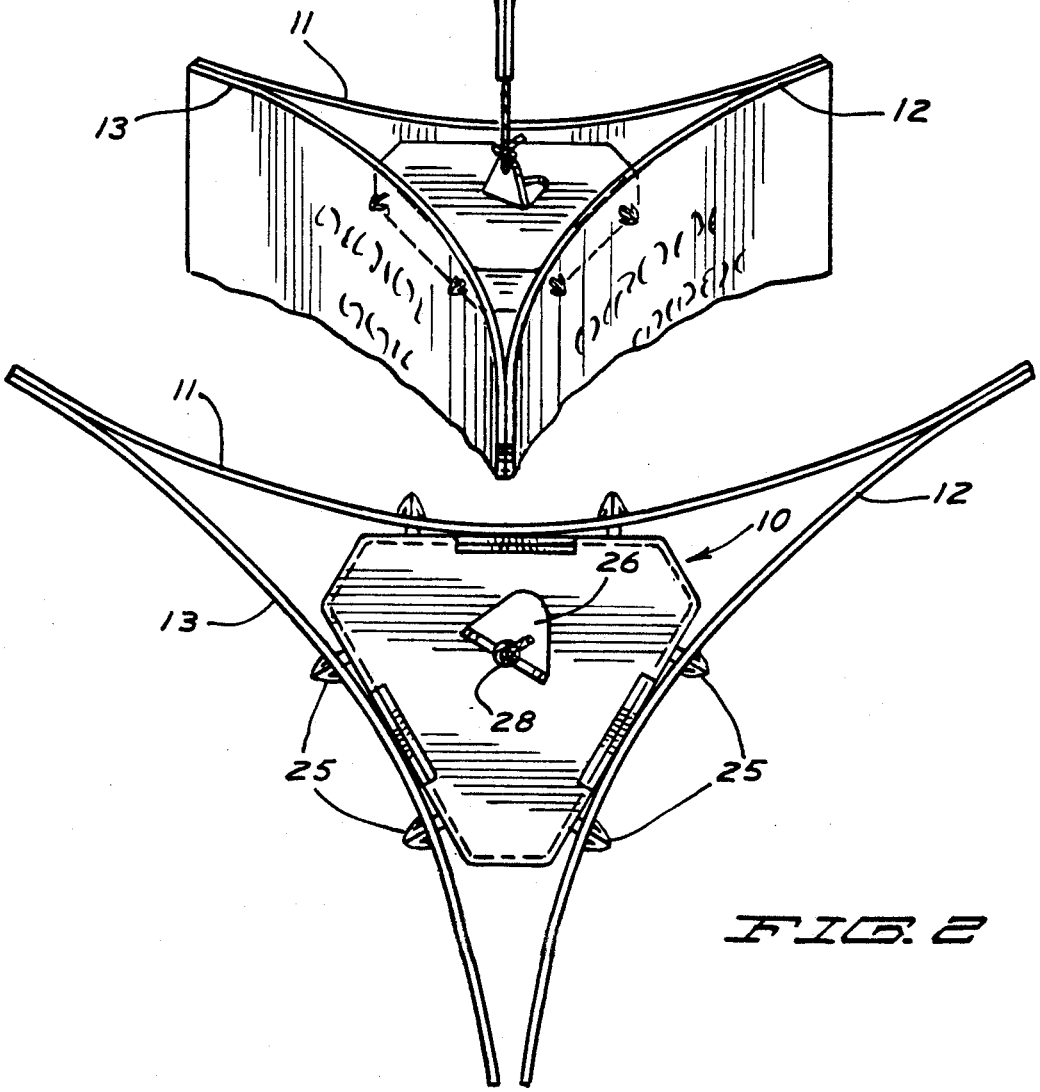
FIG. 2 is a top plan view of the showing of FIG. 1.

A popular form of a mobile or suspended sign hanger is a three sided one as shown as a die cut blank 10 in FIG. 3 and also as shown in operating position in FIGS. 1 and 2 with three posters 11–13 hung thereon from each side thereof and overlapping and engaging one another at their adjacent sides and yielding as a result of this interengagement to take on concave curvatures as shown which makes the posters readable from a wider perspective.

Referring now to FIGS. 3–5, the mobile hanger 10 is indicated as having been die cut from an appropriate card stock with the plurality of side walls 16, 17 and 18 projecting outwardly from a central wall 15, said side walls having an angular relationship to one another and having their adjacent ends 16*a*–16*b*, 17*a*–17*b* and 18*a*–18*b* spaced from one another.

Said side walls have inner edges formed as creases 16*c*, 17*c* and 18*c* and formed along said creases shown as being centrally thereof are slots 16*d*, 17*d* and 18*d*.

Extending outwardly of said central wall 18 and extending or projecting outwardly between said spaced ends of said side walls are intermediate portions 20, 21 and 22 having inner creased edges 20*a*, 21*a* and 22*a* as extensions of said creases 16*c*, 17*c* and 18*c* and therewith, forming a perimeter, in effect, about said central wall 15.

Extending across said side walls 16–18 lengthwise thereof are double creases 16*e*, 17*e* and 18*e* as illustrated to clearly define said side walls lower side wall portions 16*f*, 17*f* and 18*f* and also the upper side wall portions 16*g*, 17*g* and 18*g* thereof which are foldable over said lower wall portions.

Extending outwardly of said creases 20*a*, 21*a* and 22*a* at right angles thereto are spaced creases 20*b*, 21*b* and 22*b*. Because of the angled relationship of said side walls, said intermediate portions 20–22 have angled end portions 20*c*, 21*c* and 22*c* as illustrated. Said angled end portions are cut free from the adjacent side wall ends as shown at 22*e*.

Said lower wall portions 16*f*, 17*f* and 18*f* have spaced apertures therein indicated at 16*i*, 17*i* and 18*i* through which are projected conventional poster holding tabs 25 which have enlarged bases as at 25*a*.

Projecting outwardly of said side walls are tongues 16*j*, 17*j* and 18*j* adapted to be disposed into said respective slots for releasable locking engagement therein.

Die cut in said central wall 5 is a tab 26 having an aperture 27 therein to which may be attached any suitable hanging means such as the cord 28 in FIG. 1. It will be understood that if desired a hook not shown may first be disposed through said aperture for connection with said tab.

With particular reference now to FIGS. 4 and 5, the steps will be described for putting or folding said blank 10 as formed into an operating condition.

The side walls 16–18 and the intermediate portions therebetween 20–22 are raised to a vertical position each relative to the central wall 15. When this is done, the end portions 20*c*, 21*c* and 22*c* of the intermediate portions are folded inwardly to overlap and overlie the adjacent portions of the end walls 16–18 as indicated. Wall 16 is shown in raised position with the upper wall portion 16*g* thereof being folded to overlie the inner side of the lower wall portion 16*f* and in so doing engages and locks therebetween the adjacent ends 20*c* and 22*c* and the bases 25*a* of the poster holding tabs 25. The tongue 16*j* is disposed into the slot 16*d* to releasably lock said wall 16 in folded operating position. The wall 17 is shown in this locked position and in FIG. 5, the wall 18 being raised into position to become folded.

The poster holding tabs are thus locked into projecting position and posters are hung thereon by being pierced to be positioned thereon or they may be secured thereto by other suitable means.

The hanger 10 with posters mounted thereon may be hung singly or two or more may be hung spaced vertically as indicated by the illustration of FIG. 1.

To be emphasized here is the fact that there is a very significant advantage present in providing a die cut hanger in lieu of one which is molded and the die cut hanger as described is readily arranged into an operating use position.

The three sided hanger shown here is representative of the hanger having a plurality of sides which may be any convenient number of sides in excess of one.

Although illustrated in suspended position, said hanger may be readily pole mounted by having the tab 26 suitably secured to the raised end of a pole.

It will of course be understood that various changes may be made in the form, details, arrangement and proportions of the hanger and in the steps and sequence of steps of the method without departing from the scope of the invention which, generally stated, consists in a poster hanger and method capable of carrying out the objects set forth and the purpose indicated such as disclosed and defined in the appended claims.

What is claimed is:

1. A die cut suspended poster hanger, comprising a central wall having a plurality of co-planar side walls projecting outwardly thereabout in an angular relationship to one another, said side walls having creased inner edges forming in effect a perimeter about said central wall, a slot in each of said creased inner edges, a tongue projecting from each side wall disposable into a respective slot, a crease across each of said side walls forming lower and upper wall portions, adjacent side walls having spaced apart ends, intermediate portions of said central wall extending between said spaced ends, said intermediate portions having creased inner edges, spaced creases extending across said intermediate portions at right angles to said creased inner edges forming angled ends thereof adjacent said spaced apart ends of said side walls, said angled ends being free of the adjacent side wall ends, said lower wall portions having spaced apertures therein, poster hanging tabs projecting through each of said apertures, said tabs having enlarged base portions, and suspension means secured to said central wall to suspend said hanger, whereby by causing said side walls to become erect; said intermediate portions can be folded inwardly and the angled ends thereof overlie adjacent end portions of said lower wall portion, and said upper wall portions can be are folded to overlie an inner side of said lower wall portions having their respective tongues disposed into their respective slots securing between said upper and lower wall portions said bases of said tabs and said overlying angled ends of said intermediate portions.

2. A die cut suspended poster hanger, comprising a central wall having a plurality of co-planar side walls projecting outwardly thereabout, said side walls having inner edges forming in effect a perimeter about said central wall, a slot in each of said inner edges, a tongue projecting from each side wall disposable into a respective slot, said side walls being foldable, adjacent side walls having spaced apart ends, intermediate portions of said central wall extending between said spaced ends, said intermediate portions having creased inner edges, said intermediate portions having outer edges in alignment with outer edges of said side walls, said intermediate portions being creased at right angles to their respective inner edges forming angled end portions adjacent corresponding ends of said side walls, said angled end portions being cut free of their respective adjacent side wall ends, said side walls having poster hanging tabs projecting therethrough adjacent their respective inner edges, said tabs having enlarged base portions disposed on an inner side of said side walls, and suspension means secured to said central wall to suspend said hanger, whereby by causing said side walls to become erect, said intermediate portions can be folded inwardly and the angled end portions thereof overlie adjacent end portions of said side walls, said side walls can be folded to have their tongues disposed into their respective slots securing between the folded portions of said side walls said overlying angled end portions and said bases of said tabs.

* * * * *